US005107690A

United States Patent [19]

Phillips

[11] Patent Number: 5,107,690

[45] Date of Patent: Apr. 28, 1992

[54] KEYSAFE

[76] Inventor: E. Lakin Phillips, 2733 Centerville Rd., Herndon, Va. 22071

[21] Appl. No.: 658,692

[22] Filed: Feb. 21, 1991

[51] Int. Cl.[5] ..... E05B 65/52; E05B 67/53

[52] U.S. Cl. ..... 70/63; 70/158; 70/52

[58] Field of Search ..... 70/63, 163, 158, 51, 70/14, 54–56, 52

[56] References Cited

U.S. PATENT DOCUMENTS

| | | | |
|---|---|---|---|
| 1,613,813 | 1/1927 | Westland | 70/63 |
| 2,995,025 | 8/1961 | Toepfer | 70/58 |
| 3,386,393 | 6/1968 | Peterson et al. | 109/50 |
| 3,786,656 | 1/1974 | Suprowich | 70/63 |
| 4,573,332 | 3/1986 | Ma | 70/63 |
| 4,576,022 | 3/1986 | Gamble | 70/63 |
| 4,869,082 | 9/1989 | Appelbaum | 70/63 |
| 4,882,918 | 11/1989 | Stanich | 70/54 |

*Primary Examiner*—Renee S. Luebke
*Assistant Examiner*—Darnell M. Boucher
*Attorney, Agent, or Firm*—Lane, Aitken & McCann

[57] ABSTRACT

A portable secure container or keysafe is provided which employs a conventional combination padlock with a permanently attached U-shaped shackle. The padlock serves as both the locking mechanism and closure for the container. The padlock is inserted into a sleeve extending from the container which slidably receives the lock. The mechanism to operate the lock is located in the same opening which receives the lock. The sleeve has a hole to receive the free end of the padlock shackle and a slot which receives the permanently attached end. The slot can be "L" shaped to allow a circular padlock to be rotated within a circular sleeve a limited distance to align the free end of the shackle with a hole in the sleeve. The container can also be secured to a permanent structure by the shackle of the padlock.

6 Claims, 2 Drawing Sheets

KEYSAFE

BACKGROUND OF THE INVENTION

The present invention relates generally to secure compartments and, more particularly, to a secure compartment which employs a conventional padlock as the closure to the compartment. The shackle of the conventional padlock may be also secured to a permanent structure to prevent the theft of the container and lock combination. There are many kinds of receptacles which are designed to retain keys which can be secured with a conventional padlock. Such an arrangement is convenient in instances where it is desired to allow access to a number of individuals to a property secured by a conventional door lock when there exists only a limited number of keys available. This arrangement is further advantageous when a combination lock is employed because it allows quick access to a property from a remote location by merely communicating the combination to the individual requesting access. Such receptacles are also convenient places to keep an extra set of keys in the event that the original keys are lost and are a secure location to keep keys to boats, tractors, motorcycles and machinery. Most involve a secure receptacle having an opening which is secured closed by a separate lid or closure to the receptacle. Often the closure is mounted on hinges to the receptacle for pivotal movement. The closure is then secured in the closed position by a conventional padlock. Such enclosures require a number of parts including hinges and hardware such hasps and hasp keepers which engage the shackle of a padlock. Further the receptacle must have means to be permanently secured to a fixed object so that the locked receptacle cannot be simply carried away.

There have been a number of receptacles developed which employ a padlock and do not have a separate closure to retain the item which is desired to be secured, however the closure is achieved by the shackle of a padlock and not the casing. Accordingly, the size of the opening of the container and the items which will fit in the compartment is thus limited. The present invention meets the need for an inexpensive and effective security receptacle which can be permanently attached to a fixed object.

BRIEF DESCRIPTION OF THE INVENTION

The present invention uses a conventional combination padlock having a U-shaped shackle, with one end of the shackle permanently fixed in the casing of the padlock. The opposite end of the shackle is free to rotate around an axis formed by the fixed end of the shackle. The padlock works in conjunction with a novel receptacle having an opening slightly larger than the circumference of the casing of a circular combination padlock. The opening defines a right cylinder or sleeve adapted for slidably receiving the casing of a combination lock. The sleeve communicates with a larger receptacle which can retain keys or other objects. The receptacle is preferably of one-piece construction and manufactured from a suitable corrosion and break resistant material.

The invention provides a secure enclosure which can also be secured to a permanently secured structure. The security enclosure can be inexpensively manufactured and is easy to employ. The novel arrangement of a slot and apertures allows for the combination lock to serve as both the locking mechanism and the closure of the receptacle. Additional advantages and novel features of the present invention will be apparent from the drawings and detailed description of the device of the combination.

DETAILED DESCRIPTION OF THE PREFERRED EMBODIMENT

Figure 1:
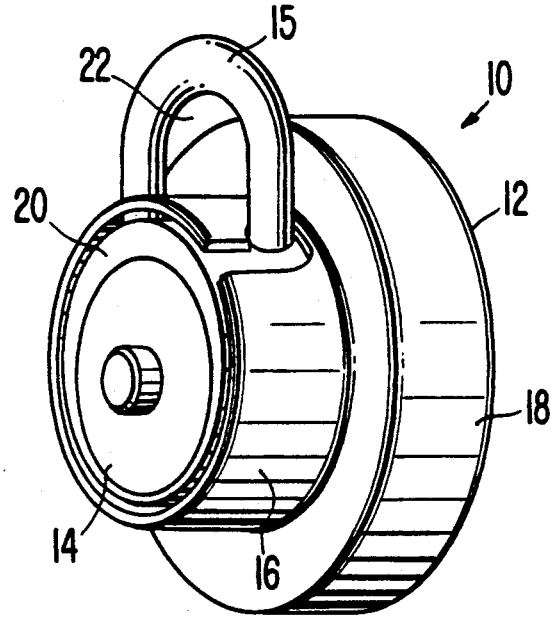
FIG. 1 is an isometric view of the padlock and container according to the present invention.

As shown in FIG. 1, the invention generally designated by the reference numeral 10 is a novel container 12 which receives a combination padlock 14 having a U-shaped shackle 15. Combination padlocks are commercially available locks which can be operated by turning a face plate in a predetermined sequence which will release one end of the shackle. The secure container 12 has a circular opening 14 which is defined by a right circular, cylindrical sleeve 16. The sleeve 16 communicates with a second larger right circular, cylinder 18 which serves as the secure compartment or chamber. The rear of the cylinder 18 is closed by a circular plate 19 contiguous with the right cylinder 18. The dimensions of the sleeve 16 are slightly larger than the dimensions of a casing 20 of the combination lock so that the casing 20 can slideably fit within the sleeve. The sleeve and compartment which make up the container are preferably a one-piece aluminum extrusion although the container could be made by casting or a variety of methods of manufacture. Although heavy gage aluminum is preferred for the material of the container, any corrosion resistant high strength metal or composite material would be suitable.

Figure 2:
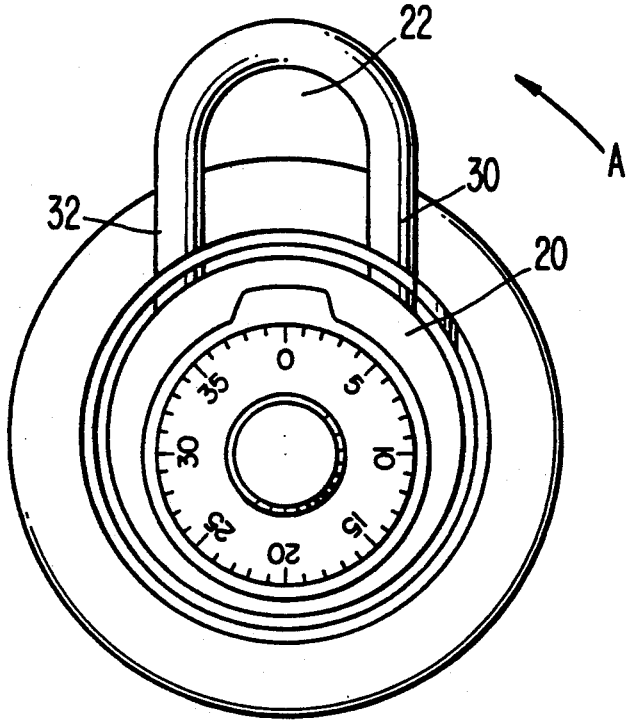
FIG. 2 is a front view of the padlock combination of the invention.

As FIG. 2 illustrates, the sleeve 16 is concentric with the larger receptacle. Also apparent from FIGS. 1. and 2. is the ability to easily attach the U-shaped shackle to a permanent structure. The size of the opening 22 is important in this respect so that there is sufficient space to pass the shackle around a permanent structure. This can be accomplished directly or by using a chain or cable attached to the shackle.

Figure 3:
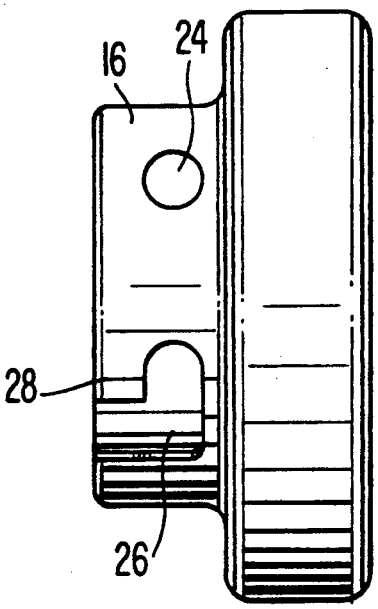
FIG. 3 is a side view of the security container which shows the slot and aperture arrangement.

As illustrated in FIG. 3, the sleeve of the receptacle 14 is provided with an aperture 24 and a L-shaped slot 26 which receive the U-shaped shackle of the padlock. The aperture 24 is circular and is slightly larger than the shackle. The slot 26 is slightly wider than the width of the shackle 15 and is open ended at the rim of the sleeve 16. The slot extends rearward and axially from the rim of the sleeve and then turns at a right angle to extend along the circumference of the sleeve for a distance about equal to the width of the shackle 15. When the distal end of the shackle is passed through the aperture 24 to engage the casing 20, a projection 28 will prevent the proximal end of the shackle from movement towards the opening of the receptacle. The distance between the closed end of slot 26 and the aperture 24 is slightly smaller than the distance between the ends of the shackle. After the shackle is secured in the casing, rotation of the casing in the sleeve is prevented by the slot and aperture configuration.

Figure 4:
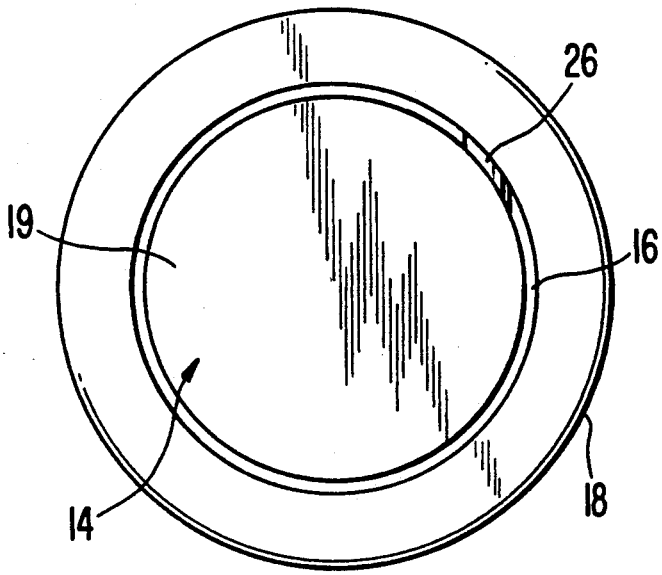
FIG. 4 is a front view of the container according to the present invention.

As is best seen in FIGS. 2 and 4, the sidewalls of slot 26 and aperture 24 are not radial or perpendicular to a tangent to the sleeve, but are cut at an angle corresponding to the angle which the shackle ends exit the casing 20 of the lock. This angle allows the shackle to pass through a more narrow slot than a slot with radial sidewalls.

In operation, the combination padlock 14 is unlocked so that the proximal end 32 of the shackle is free to rotate and move a limited distance in and out of the casing 20. The proximal end of the shackle 15 can rotate on its own axis at a point where the shackle enters the casing 20. The lock is positioned with the shackle extending out from the casing 20 as far as permitted and is aligned with the open end of the slot 26 which communicates with the circular opening 14 of the sleeve. The casing of the lock is slid rearward into the sleeve 16 and the slot 26 receives the proximal end 20 of the shackle 15. The lock is then rotated within the sleeve in the direction indicated by the arrow A, to follow the turn of the slot until the shackle reaches the end of the slot 26. After the lock is rotated as far as permitted in the slot, the distal end 32 of the shackle can be rotated around the shackle axis to align with the aperture 24 in sleeve 16. The aperture 24 is located a predetermined and precise distance from the end of slot 26 to receive the distal end 32 of the shackle. When the distal end 32 is aligned with the aperture 24, pressure is applied to the top of the shackle so that the distal end moves in the direction towards the casing 20 and passes through the aperture 24 and into the casing 20 to engage the locking mechanism. As is apparent from FIGS. 1 and 2, the casing of the lock forms the closure of the secure receptacle.

While a preferred form of the invention has been disclosed here, it will be apparent to those skilled in the art that modifications and improvements can be made to the specific form herein disclosed without departing from the spirit and scope of the invention.

I claim:

1. A secure container comprising means defining a chamber having a circular opening and a padlock, said opening being adapted to slidably receive said padlock, said means defining a chamber and said opening being shaped so that access to said chamber is closed when said padlock is received in said opening, said padlock comprising a U-shaped shackle and a circular casing, one end of said shackle being permanently attached to said casing, said opening being defined by a circular sleeve having an aperture and a slot, said aperture and said slot being arranged and positioned so that said aperture receives a distal end of said U-shaped shackle and said slot receives a said permanently attached end of said U-shaped shackle.

2. The secure container disclosed in claim 1, wherein said padlock is a combination padlock.

3. A secure container comprising means defining a chamber having a circular opening and a padlock, said opening being adapted to slidably receive said padlock, said padlock comprising a U-shaped shackle and a circular casing, one end of said shackle being permanently attached to said casing, said opening being defined by a circular sleeve having an aperture and a slot, said aperture and said slot being arranged and positioned so that said aperture receives a distal end of said U-shaped shackle and said slot receives a said permanently attached end of said U-shaped shackle, where said slot is L-shaped having an entrance leg communicating with the entrance of said sleeve and a foot portion extending around the circumference of the sleeve.

4. A secure container comprising a chamber having an opening, said opening defining a sleeve having a slot and aperture, and a padlock having a permanently attached U-shaped shackle, said aperture and said slot being shaped and arranged so that said padlock can be inserted in said sleeve to enclose an object in said chamber and be locked into position by engagement of said shackle in said slot and aperture, said padlock having manually operable means to disengage said shackle accessible through said sleeve opening.

5. The secure container as claimed in claim 4, wherein said opening is circular and said padlock has a circular casing to fit in said circular opening.

6. The secure container as recited in claim 1, further comprising a slot shaped and arranged to require rotation of said padlock in said sleeve in order to remove said padlock from said sleeve.

* * * * *